US008900110B2

(12) United States Patent
Jung

(10) Patent No.: US 8,900,110 B2
(45) Date of Patent: Dec. 2, 2014

(54) PAPER FOLDING APPARATUS FOR BINDING MACHINE

(75) Inventor: Kijo Jung, Seoul (KR)

(73) Assignee: Biztechone Co., Ltd., Seoul (KR)

( * ) Notice: Subject to any disclaimer, the term of this patent is extended or adjusted under 35 U.S.C. 154(b) by 756 days.

(21) Appl. No.: 13/187,980

(22) Filed: Jul. 21, 2011

(65) Prior Publication Data

US 2012/0046153 A1 Feb. 23, 2012

(30) Foreign Application Priority Data

Aug. 23, 2010 (KR) ..... 10-2010-0081386

(51) Int. Cl.
*B65H 45/00* (2006.01)
*B65H 45/18* (2006.01)

(52) U.S. Cl.
CPC ..... *B65H 45/18* (2013.01); *B65H 45/00* (2013.01); *B65H 2801/27* (2013.01)
USPC ..... 493/360; 493/440; 493/444

(58) Field of Classification Search
CPC ..... B65H 45/00
USPC ..... 493/444, 440
See application file for complete search history.

(56) References Cited

U.S. PATENT DOCUMENTS

| | | | | |
|---|---|---|---|---|
| 3,117,777 | A * | 1/1964 | Funk | 493/444 |
| 4,909,779 | A * | 3/1990 | Schaffron | 493/235 |
| 5,437,442 | A * | 8/1995 | Petersen | 270/45 |
| 6,733,006 | B2 * | 5/2004 | Kobayashi et al. | 270/37 |
| 6,939,283 | B2 * | 9/2005 | Sparano et al. | 493/424 |
| 7,815,179 | B2 * | 10/2010 | Taguchi et al. | 270/52.17 |

* cited by examiner

*Primary Examiner* — Thanh Truong
*Assistant Examiner* — Praachi M Pathak
(74) *Attorney, Agent, or Firm* — Birch, Stewart, Kolasch & Birch, LLP

(57) ABSTRACT

A paper folding apparatus for a binding machine, capable of discharging paper sheets by folding the paper sheets twice, includes a first knife unit and a second knife unit. The first knife unit has a first feeding path and a pair of first paper folding rollers. The second knife unit has a second feeding path and a pair of second paper folding rollers. A paper arranging guide is installed in front of the pair of first paper folding rollers, and the second knife unit includes a pinion, a rack selectively engaged with the pinion, a rack guide configured to provide a path on which the rack is moved, a resilient member resiliently supporting the rack, and a second paper folding knife configured to move back and forth between the second paper folding rollers in association with a moving direction of the rack.

5 Claims, 11 Drawing Sheets

PAPER FOLDING APPARATUS FOR BINDING MACHINE

BACKGROUND OF THE INVENTION

1. Field of the Invention

The present invention relates to a paper folding apparatus for a binding machine.

More particularly, the present invention relates to a paper folding apparatus for a binding machine adapted to discharge a paper sheet by folding twice the paper sheet fed from an image forming apparatus, such as a printer, to the binding machine.

2. Description of the Related Art

In general, image forming apparatuses, such as copy machines and printers, are equipped with various automatic sorting apparatuses for arranging and stacking paper sheets discharged from a paper discharging unit, and binding machines for stapling a discharged paper sheet after folding the discharged paper sheet or discharging the paper sheet in a folded state.

A folding knife and a folding roller are generally necessary to fold a paper sheet using a paper folding apparatus of a binding machine. A knife driving apparatus and a folding roller are additionally necessary to fold a paper sheet twice or more, so the structure of the paper folding apparatus is complicated and the size of the paper folding apparatus is enlarged.

Moreover, the manufacturing costs may increase due to the installation of the knife driving apparatus.

SUMMARY

The present invention has been made to solve the problems occurring in the prior art, and an object of the present invention is to provide a paper folding apparatus for a binding machine which can be made in a small size and may have an improved paper folding function.

It is another object of the present invention to provide a paper folding apparatus for a binding machine which can drive a secondary paper folding knife using a driving system that prevents a paper arranging guide from interfering with a primary paper folding operation, thereby improving the performance with a simple structure.

It is a further object of the present invention to provide a paper folding apparatus for a binding machine which can fold a paper sheet twice at low manufacturing costs.

In order to accomplish the above object, the present invention provides a paper folding apparatus for a binding machine. The paper folding apparatus includes a first knife unit including a first feeding path for feeding a paper sheet and a pair of first paper folding rollers installed on the first feeding path, the first knife unit being configured to push the paper sheet located on the first feeding path toward the pair of first paper folding rollers such that the paper sheet passes between the pair of first paper folding rollers in a primarily folded state; and a second knife unit including a second feeding path for feeding the primarily folded paper sheet and a pair of second paper folding rollers installed on the second feeding path, the first knife unit being configured to push the primarily folded paper sheet toward the pair of second paper folding rollers such that the primarily folded paper sheet passes between the pair of second paper folding rollers in a secondarily folded state.

One of the pair of first paper folding rollers and one of the pair of second paper folding rollers are shared.

The first knife unit includes a first paper folding knife configured to move back and forth between the pair of first paper folding rollers, and a drive unit configured to move the first paper folding knife back and forth.

A paper arranging guide for guiding the paper sheet on the first feeding path is installed in front of the pair of first paper folding rollers and the paper arranging guide is moved before the first knife unit is driven so that the paper arranging guide does not interfere with the paper sheet being folded.

The second knife unit includes a pinion configured to move in association with driving of the paper arranging guide, a rack selectively engaged with the pinion, a rack guide configured to provide a path on which the rack is moved, a resilient member configured to resiliently support the rack so that the rack is held in a home position, and a second paper folding knife configured to move back and forth between the second paper folding rollers in association with a moving direction of the rack.

The pinion is rotatably fixed to both ends of a drive shaft of one of the pair of first paper folding rollers, and both ends of the paper arranging guide are fixed to the pinion eccentrically with a central axis of the pinion.

The pinion and the paper arranging guide are reversibly rotatable independently from rotation of the pair of first paper folding rollers.

The pinion has a fan-like shape.

The resilient member is a tension spring.

According to another aspect of the present invention, there is provided a paper folding apparatus for a binding machine, in which the paper folding apparatus includes a first knife unit including a first feeding path for feeding a paper sheet and a pair of first paper folding rollers installed on the first feeding path, the first knife unit being configured to push the paper sheet located on the first feeding path toward the pair of first paper folding rollers such that the paper sheet passes between the pair of first paper folding rollers in a primarily folded state; and a second knife unit including a second feeding path for feeding the primarily folded paper sheet and a pair of second paper folding rollers installed on the second feeding path, the first knife unit being configured to push the primarily folded paper sheet toward the pair of second paper folding rollers such that the primarily folded paper sheet passes between the pair of second paper folding rollers in a secondarily folded state.

A paper arranging guide for guiding the paper sheet on the first feeding path is installed in front of the pair of first paper folding rollers, and the second knife unit includes a pinion configured to move in association with driving of the paper arranging guide, a rack selectively engaged with the pinion, a rack guide configured to provide a path on which the rack is moved, a resilient member configured to resiliently support the rack so that the rack is held in a home position, and a second paper folding knife configured to move back and forth between the second paper folding rollers in association with a moving direction of the rack.

According to the paper folding apparatus for a binding machine of the present invention, the second knife unit 200 is driven by using a power system for moving the paper arranging guide 250 installed in front of the pair of first paper folding rollers 50 and configured to guide a paper sheet on the first feeding path 30 such that the paper arranging guide 250 may not interfere with the first paper folding operation, and one of the pair of first paper folding rollers 50 and one of the pair of second paper folding rollers 150 can be shared. Therefore, the performance of the paper folding apparatus for a binding machine can be improved with an inexpensive and simple structure.

BRIEF DESCRIPTION OF THE DRAWINGS

The above and other aspects, features and advantages of the present invention will be more apparent from the following detailed description taken in conjunction with the accompanying drawings, in which.

DETAILED DESCRIPTION OF THE EMBODIMENTS

Hereinafter, the configuration and operation of a paper folding apparatus for a binding machine according to the present invention will be described in detail with reference to FIGS. 2 to 4.

Figure 1:
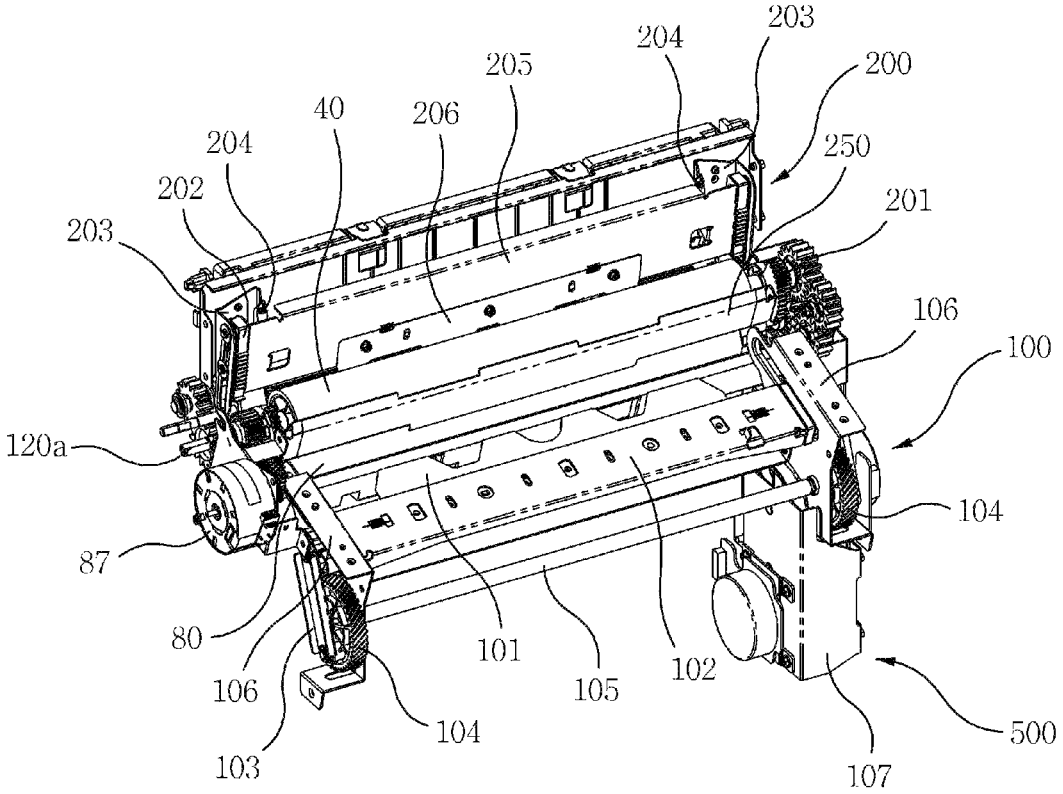
FIG. 1 is a perspective view illustrating a paper folding apparatus for a binding machine according to the present invention.
Figure 2:
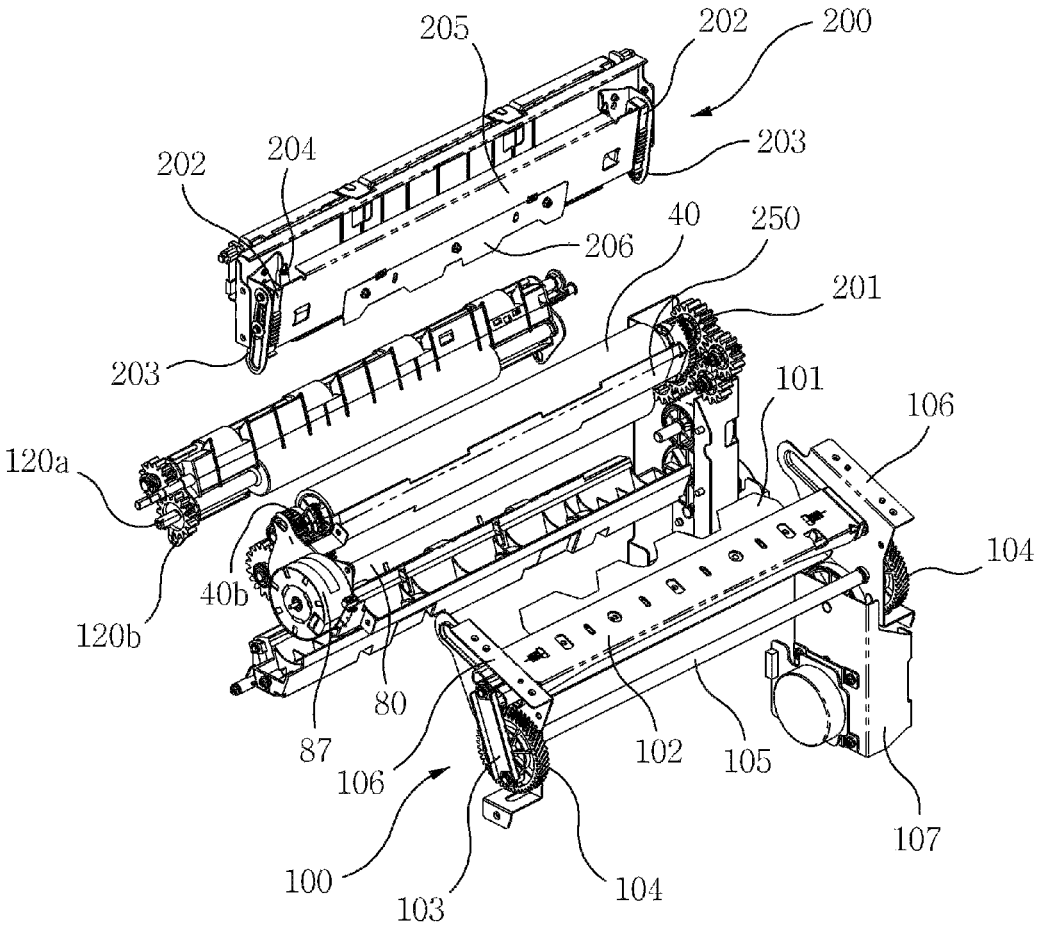
FIG. 2 is an exploded perspective view of the paper folding apparatus for a binding machine according to the present invention when viewed from one side.
Figure 3:
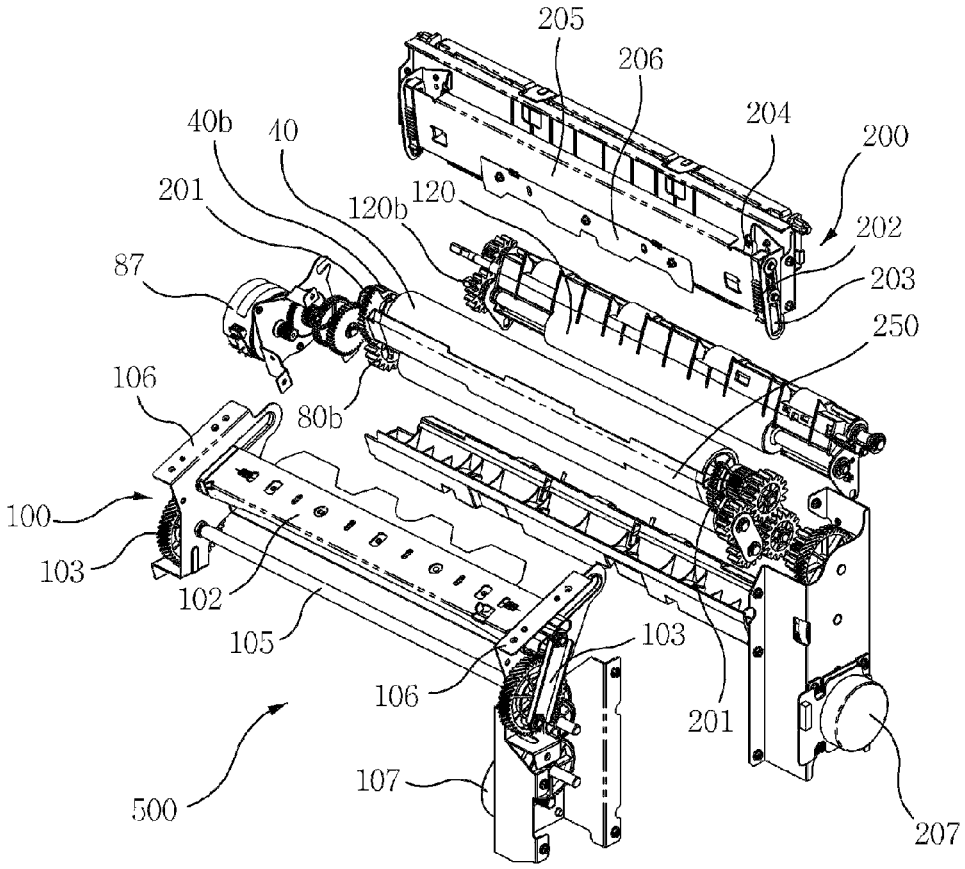
FIG. 3 is an exploded perspective view of the paper folding apparatus for a binding machine according to the present invention when viewed from the other side.
Figure 4:
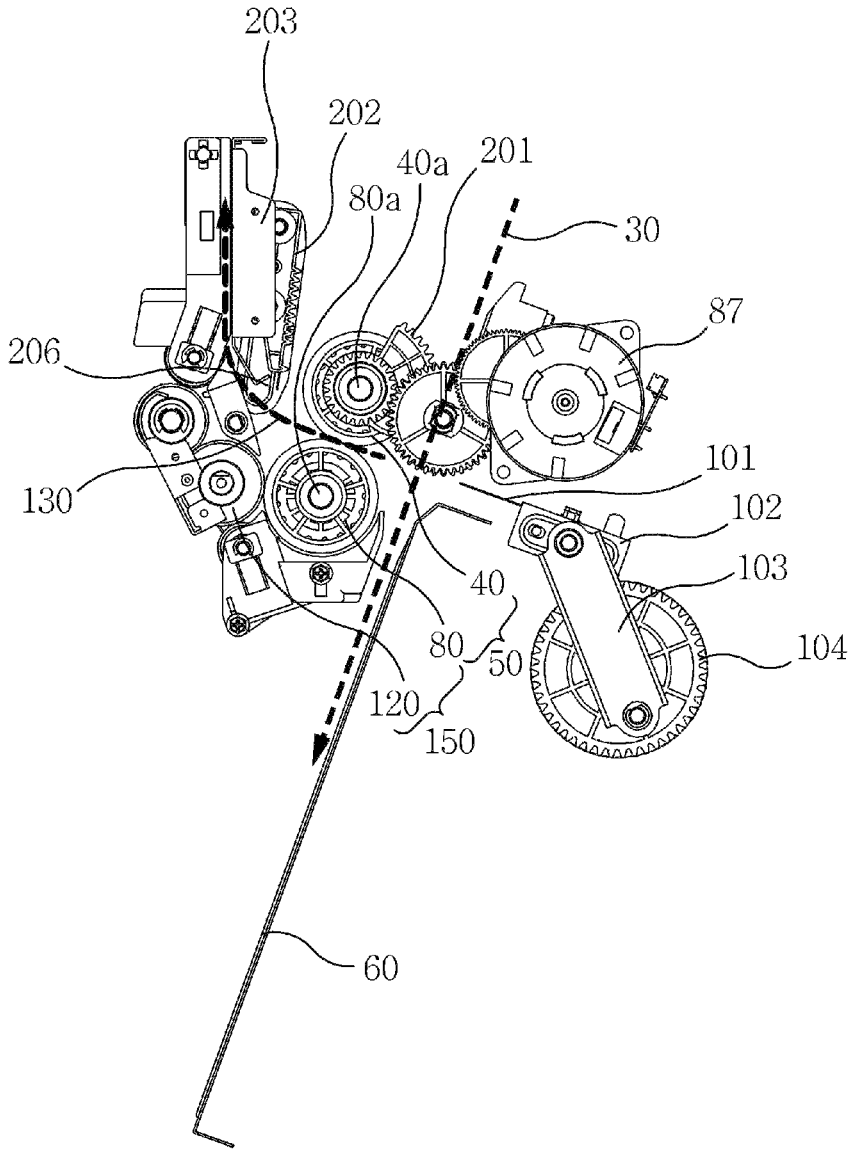
FIG. 4 is a side view illustrating the paper folding apparatus for a binding machine according to the present invention.

A paper support plate 60 of FIG. 4 is omitted in FIGS. 1 to 3 to avoid complexity, and a guide 106 and a drive motor 107 of FIGS. 1 to 3 are also omitted in FIG. 4 to avoid complexity.

The paper folding apparatus 500 for a binding machine according to the present invention includes a first knife unit 100, a second knife unit 200, a pair of first paper folding rollers 50, and a pair of second paper folding rollers 150.

The first knife unit 100 includes a support body 102 to which the first paper folding knife 101 is fixed, crank shafts 103 rotatably fixed to both ends of the support body 102, gears configured to eccentrically fix the crank shafts 103, and a rotary shaft 105 to which the gears 104 are fixed. The both ends of the support body 102 are coupled to guides 106 such that the support body 102 can linearly reciprocate as the crank shafts 103 are eccentrically driven during rotation of the gears 104. The linear reciprocation of the support body 102 is achieved by a drive motor 107 engaged with one of the gears 104. The first paper folding knife 101 is moved back and forth between the pair of first paper folding rollers 50 while being guided by the guides 106 during driving of the drive motor 107.

The pair of first paper folding rollers 50 is installed at an intermediate portion of the first feeding path 30 along which the paper sheet is fed, and includes rollers 40 and 80. The rollers 40 and 80 are fixed to drive shafts 40*a* and 80*a* respectively, and gears 40*b* and 80*b* are engaged with ends of the drive shafts 40*a* and 80*a*. A plurality of additional gears are interposed between the gears 40*b* and 80*b* so that a rotational force of the drive motor 87 can be transferred to the additional gears. Although a rotational force of the drive motor 87 can be transferred to the gear 80*b* through the gear 40*b* dependently according to the present invention, a rotational force of the drive motor 87 may be transferred to the gear 40*b* through the gear 80*b* dependently.

Meanwhile, a paper arranging guide 250 is installed in front of the pair of first paper folding rollers 50 to arrange or guide the paper sheet fed on the first feeding path 30. The paper arranging guide 250 is spaced apart from the roller 40 in parallel to the roller 40, and a ball bearing (not shown) is interposed between the paper arranging guide 250 and the roller 40 so that the paper arranging guide 250 is not moved in association with rotation of the roller 40. The paper arranging guide 250 is fixed to an upper side of fan-like pinions 201 rotatably supported by the drive shaft 40*a* so as to be eccentric to the central axis of the pinion, whereby the paper arranging guide 250 remains spaced apart from the roller 40 in parallel to the roller 40. That is, the pinions 201 and the roller 40 are rotated about a common rotary shaft, i.e. the drive shaft 40*a*, but are driven respectively by a drive motor 87 and a drive motor 207.

The pair of second paper folding rollers 150 is installed at an intermediate portion of the first feeding path 30 along which the paper sheet is fed, and includes rollers 80 and 120. The roller 120 is fixed to a drive shaft 120*a*, and a gear 120*b* is fixed to one end of the drive shaft 120*a*. The gear 120*b* is engaged with the gear 80*b*.

Thus, the roller 80 constituting both the pair of first paper folding rollers 50 and the pair of second paper folding rollers 150 is used in common, and the pair of first paper folding rollers 50 and the pair of second paper folding rollers 150 are simultaneously rotated to discharge a paper sheet only by transferring a driving force to any one of the three rollers.

The second knife unit 200 is configured to push a paper sheet on the second feeding path 130 toward the pair of second paper folding rollers 150 and pass the paper sheet between the pair of second paper folding rollers 150 with the sheet being folded second.

The second knife unit 200 includes racks 202, rack guides 203 configured to guide linear movements of the racks 202, a support body 205 fixed to the racks 202, and a second paper folding knife 206 fixed to the support body 205. The support body 205 to which the second paper folding knife 206 is fixed is fixed to a tension spring 204, and the tension spring pulls the support body 205 upward and resiliently supports the support body 205 so that the support body 205 can always maintain a home position when the racks 202 and the pinions 201 are not engaged with each other. That is, if the pinions 201 are rotated by the drive motor 207 and engaged with the racks 202, they move toward the downsides of the racks 202 to move the second paper folding knife 206 toward the pair of paper folding rollers 150. The pinions 201 are reversely rotated by a predetermined angle using the drive motor 207 to move the racks 202 to the original positions.

The operation of the paper folding apparatus 500 for a binding machine according to the present invention will be described in detail with reference to FIGS. 5A to 5G.

Figure 5A:
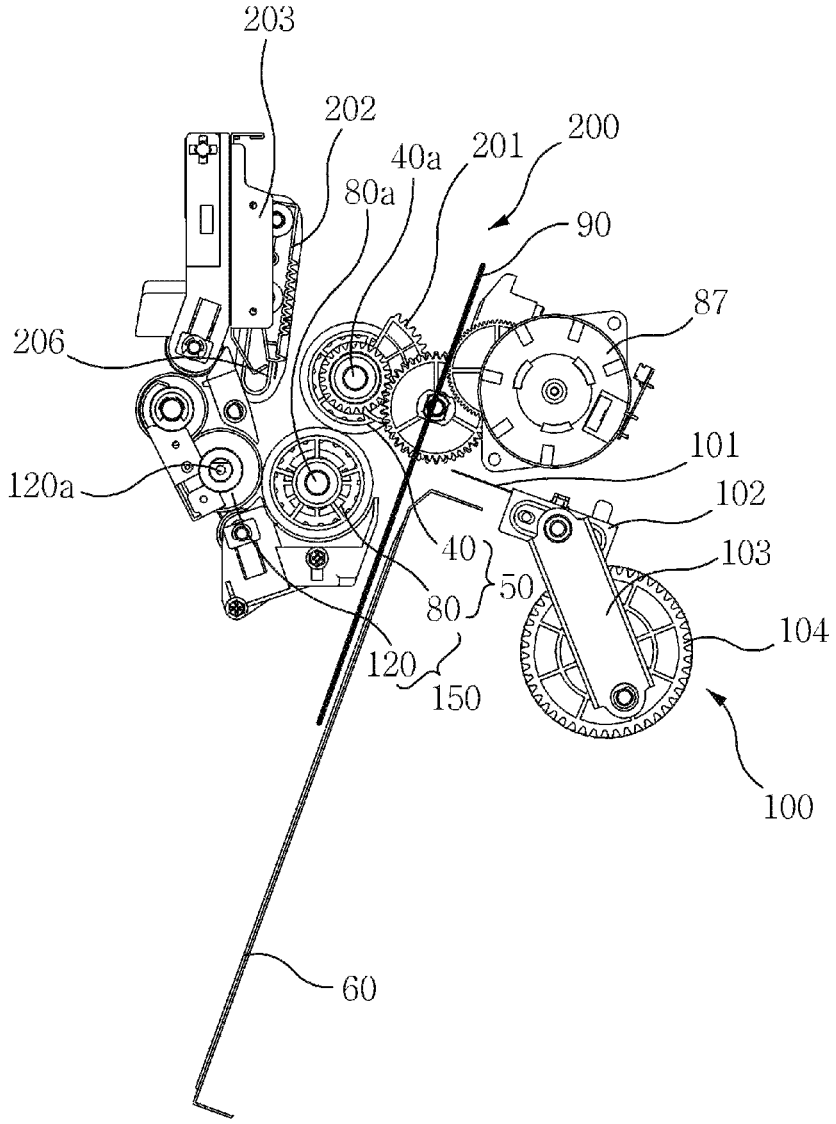
FIGS. 5A to 5G are views for explaining the operation of the paper folding apparatus for a binding machine according to the present invention.

First, a paper sheet 90 is fed along the first feeding path 30 as in FIG. 5A.

The paper sheet 90 fed along the first feeding path 30 is guided by the paper support plate 60 and the paper arranging guide 250 and is discharged along the first feeding path 30 as it is when it is not folded.

Figure 5B:
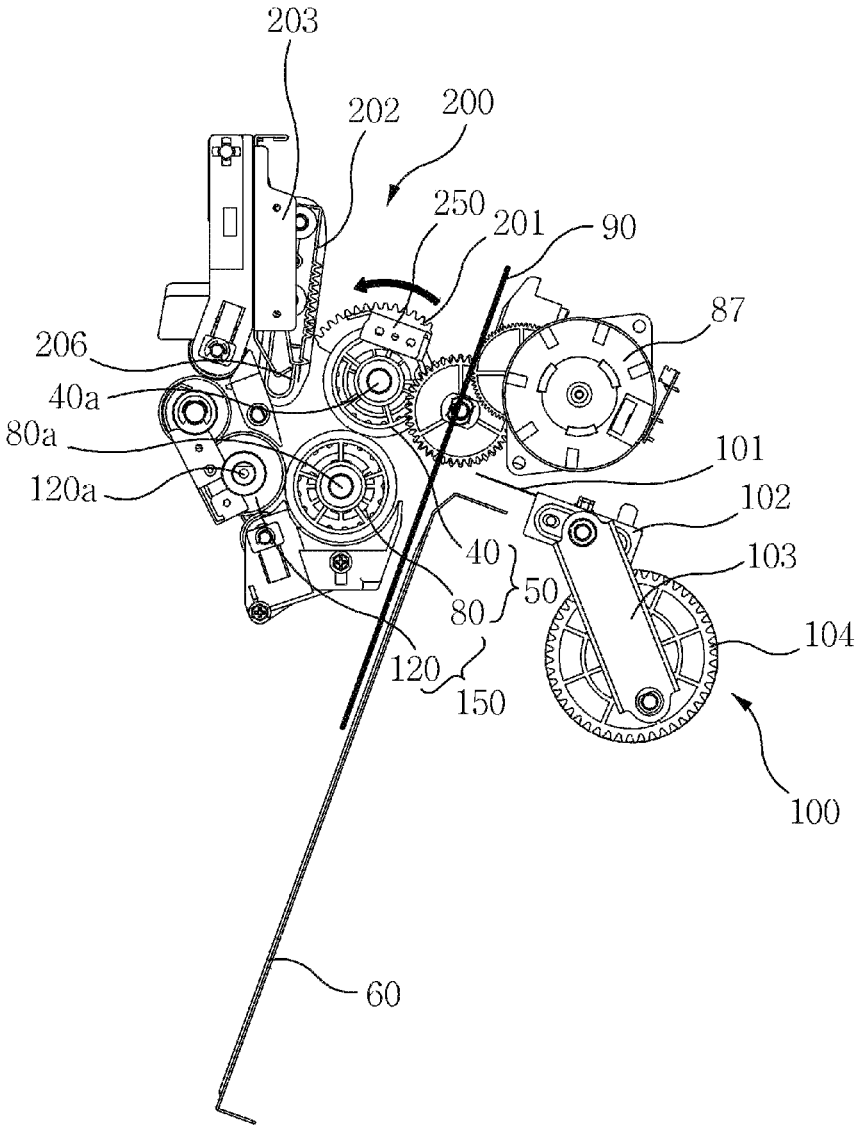

When the paper sheet is folded on the first feeding path 30, the paper arranging guide 250 is moved so as not to interfere with the first paper folding operation as shown in FIG. 5B before driving of the first knife unit 100. The movement of the paper arranging guide 250 is achieved by rotating the pinions 201, to which the paper arranging guide 250 is attached, by a predetermined angle using the drive motor 207.

If the paper arranging guide 250 is not moved during the first paper folding operation, a friction is caused between the paper sheet 90 and the paper arranging guide 250 when the paper sheet 90 is pushed between the pair of first paper folding rollers 50 by driving the first knife unit 100, causing a paper folding error. Thus, the paper arranging guide 250 is previously moved to avoid the paper folding error.

Figure 5C:
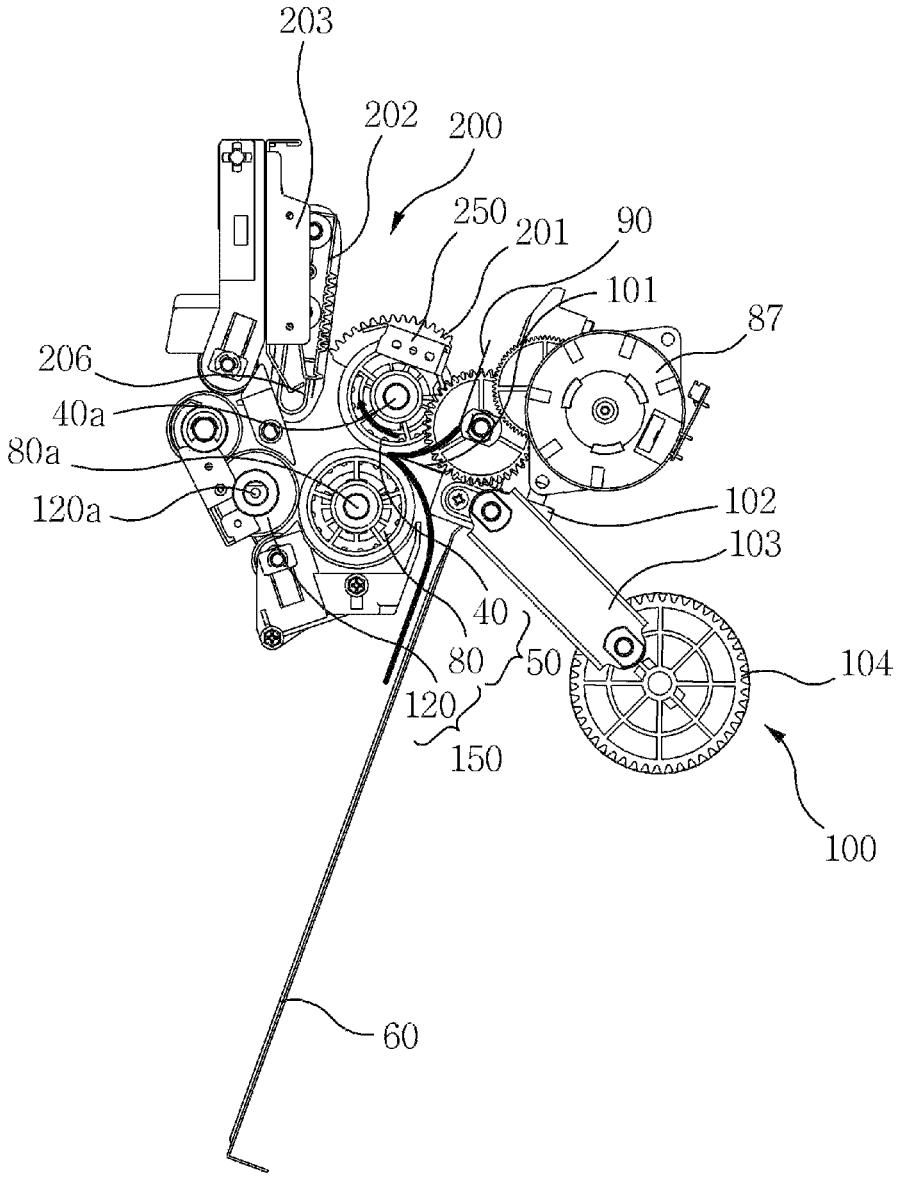

If the paper arranging guide 250 is moved as in FIG. 5B, the first paper folding knife 101 is pushed toward the pair of first paper folding rollers 50 by driving the first knife unit 100 as in FIG. 5C so that the paper sheet folded first can be discharged between the pair of first paper folding rollers 50.

It is apparent that the pair of first paper folding rollers 50 are controlled to be previously rotated by the drive motor 87 at the same time when or before the first knife unit 100 is driven, so that the fed paper sheet folded first can be discharged toward the second feeding path 130.

Figure 5D:
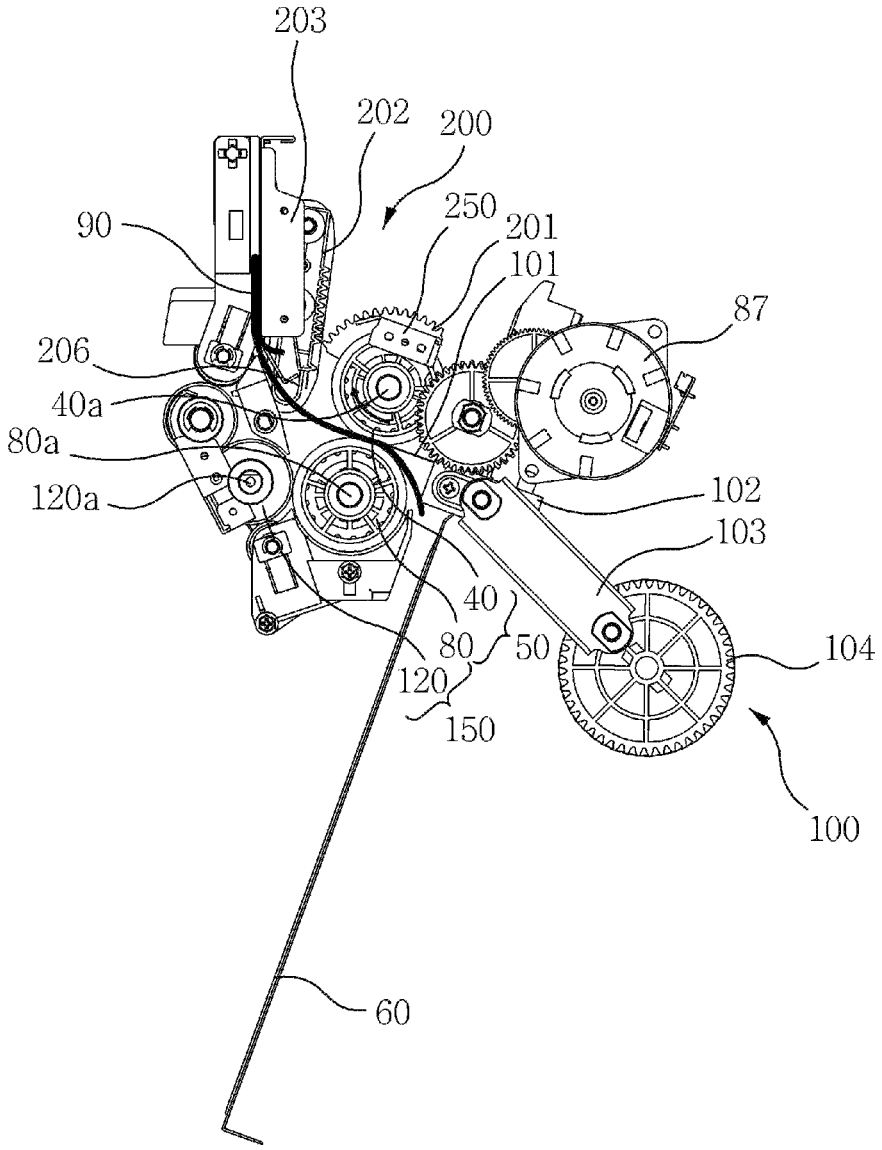

If the pair of first paper folding rollers 50 are further driven in the state of FIG. 5C, the paper sheet 90 folded first is discharged along the second feeding path 130 as in FIG. 5D.

If there is no need to fold the paper sheet 90 second, the paper sheet 90 folded first may be discharged through the second feeding path 130 as it is.

Figure 5E:
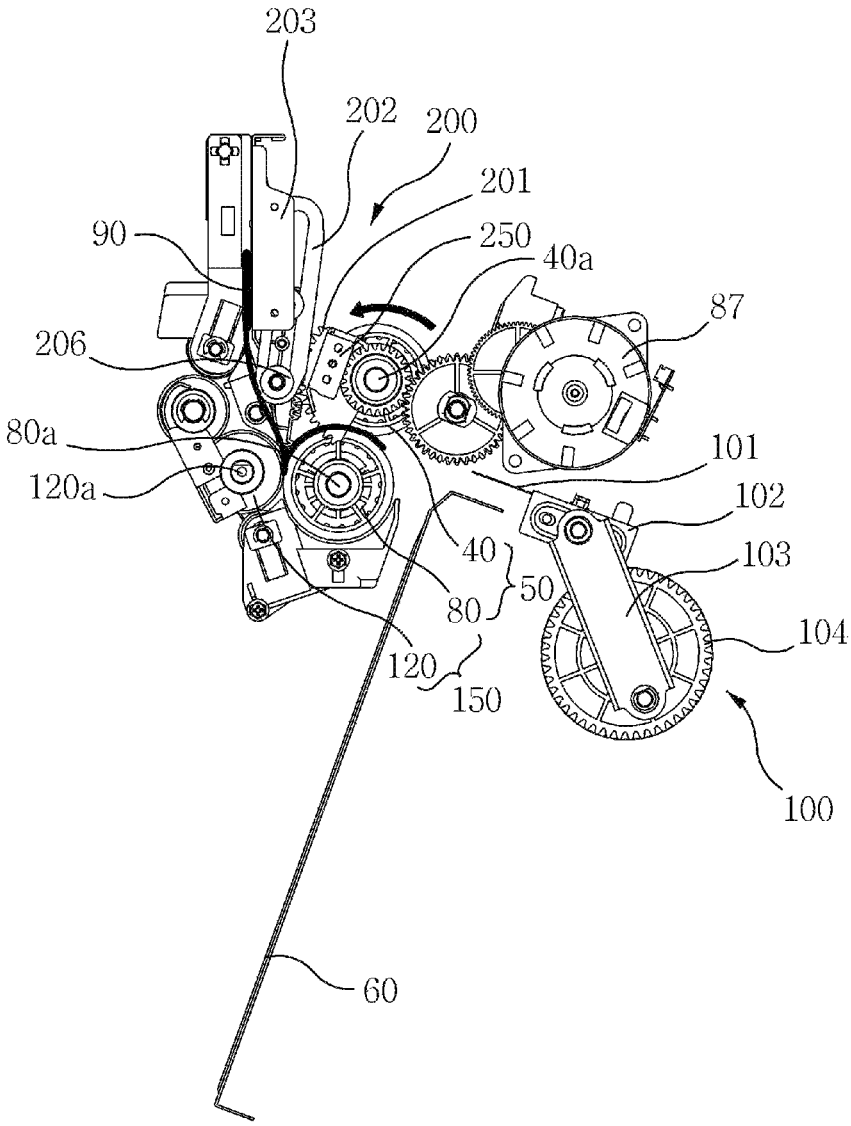

When it is necessary to fold the paper sheet 90 second, the second paper folding knife 206 is pushed toward the pair of second paper folding rollers 150 by driving the second knife unit 200 as in FIG. 5E after the paper sheet 90 folded first is fed to a certain position on the second feeding path 130, and the paper sheet 90 to be folded second is pushed between the pair of second paper folding rollers 150.

The driving of the second knife unit 200 is achieved by rotating the pinions 201 by a predetermined angle using the drive motor 207 and lowering the second paper folding knife 206 toward the pair of second paper folding rollers 150 using the engagement of the pinions 201 and racks 202.

Figure 5F:
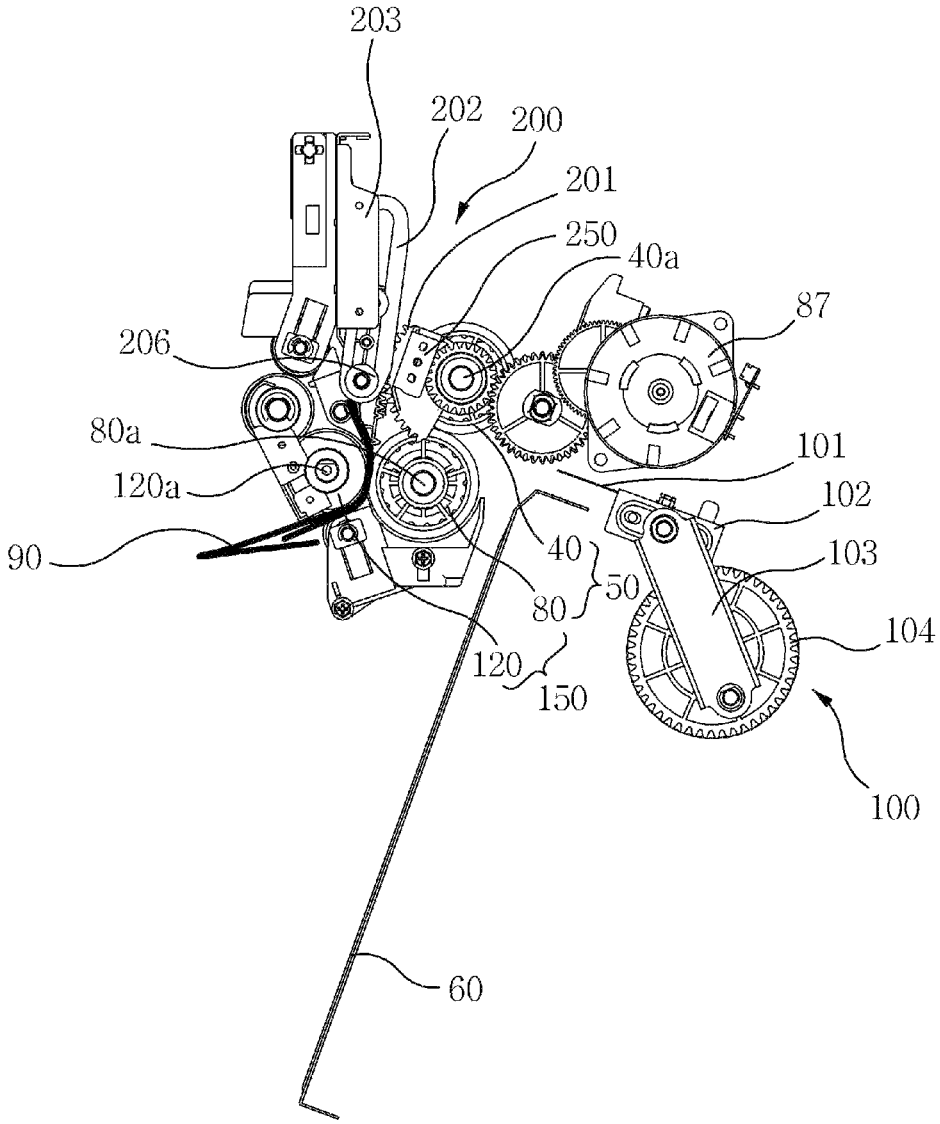

If the pair of second paper folding rollers 150 are further driven in the state of FIG. 5E, the paper sheet 90 folded second is discharged to the outside between the pair of second paper folding rollers 150 as in FIG. 5F.

Figure 5G:
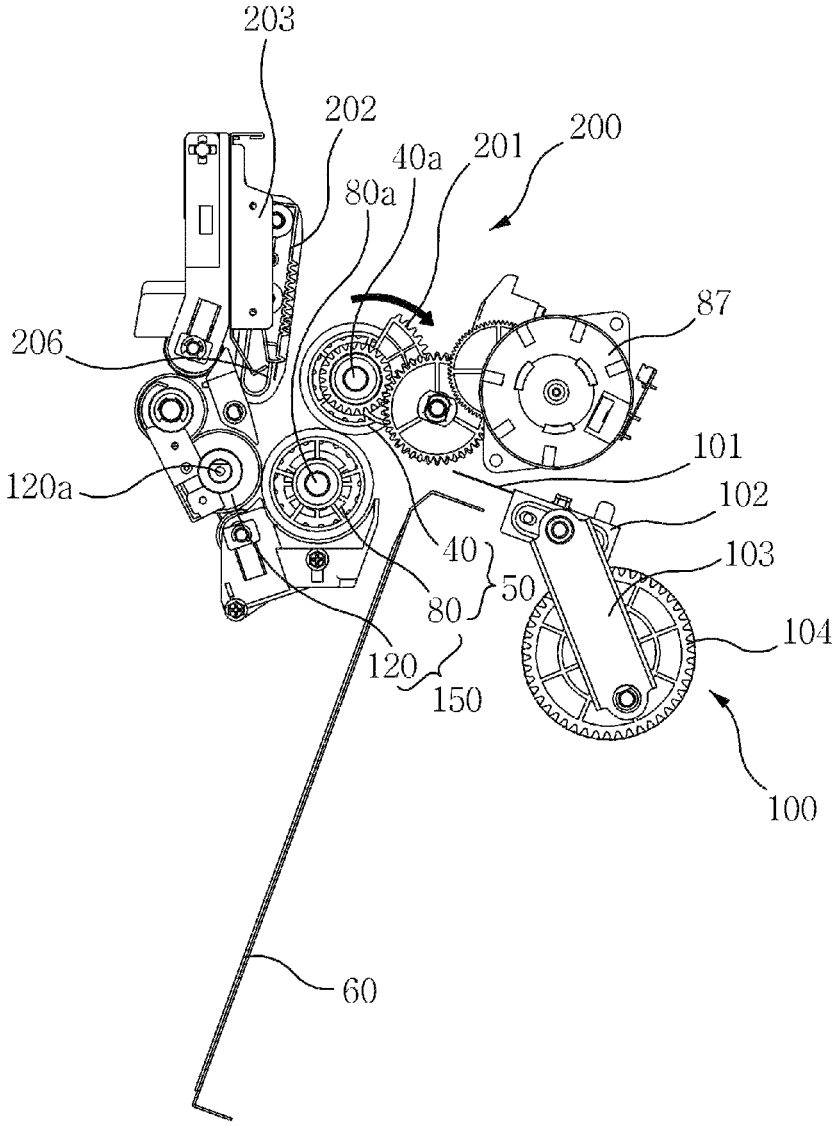

After the paper sheet 90 folded second is discharged between the pair of second paper folding rollers 150, the drive motor 207 is reversely driven as in FIG. 5G. Then, if the pinions 201 are reversely rotated by a predetermined angle, the engagement of the racks 202 and the pinions 201 is released and the support body 205 and the second paper folding knife 206 supported by the tension spring 204 are not lowered, but held in the home position.

Although a paper folding apparatus for a binding machine according to an embodiment of the present invention has been described with reference to the accompanying drawings, the present invention is not limited by the illustration and description of the embodiment.

Therefore, it will be understood to those skilled in the art that various modifications, additions and substitutions are possible, without departing from the scope and spirit of the invention as disclosed in the accompanying claims.

What is claimed is:

1. A paper folding apparatus for a binding machine, the paper folding apparatus comprising:

a first knife unit including a first feeding path for feeding a paper sheet and a pair of first paper folding rollers installed on the first feeding path, the first knife unit being configured to push the paper sheet located on the first feeding path toward the pair of first paper folding rollers such that the paper sheet passes between the pair of first paper folding rollers in a primarily folded state; and a second knife unit including a second feeding path for feeding a primarily folded paper sheet and a pair of second paper folding rollers installed on the second feeding path, the first knife unit being configured to push the primarily folded paper sheet toward the pair of second paper folding rollers such that the primarily folded paper sheet passes between the pair of second paper folding rollers in a secondarily folded state, wherein one of the pair of first paper folding rollers and one of the pair of second paper folding rollers are shared, wherein a paper arranging guide for guiding the paper sheet on the first feeding path is installed in front of the pair of first paper folding rollers and the paper arranging guide is moved before the first knife unit is driven so that the paper arranging guide does not interfere with the paper sheet being folded, wherein the second knife unit includes a pinion configured to move in association with driving of the paper arranging guide, a rack selectively engaged with the pinion, a rack guide configured to provide a path on which the rack is moved, a resilient member configured to resiliently support the rack so that the rack is held in a home position, and a second paper folding knife configured to move back and forth between a pair of second paper folding rollers in association with a moving direction of the rack, and wherein the pinion is rotatably fixed to both ends of a drive shaft of one of the pair of first paper folding rollers, and both ends of the paper arranging guide are fixed to the pinion eccentrically with a central axis of the pinion.

2. The paper folding apparatus of claim 1, wherein the first knife unit includes a first paper folding knife configured to move back and forth between the pair of first paper folding rollers, and a drive unit comprising a support body fixed to the first paper folding knife, crankshafts and gears fixed to both ends of the support body, and a drive motor to rotate the gears.

3. The paper folding apparatus of claim 1, wherein the pinion and the paper arranging guide are reversibly rotatable independently from rotation of the pair of first paper folding rollers.

4. The paper folding apparatus of claim 1, wherein the pinion has a fan-like shape.

5. The paper folding apparatus of claim 1, wherein the resilient member is a tension spring.

* * * * *